US005141270A

United States Patent [19]

Shibata

[11] Patent Number: 5,141,270

[45] Date of Patent: Aug. 25, 1992

[54] VEHICLE DOOR LOCK DEVICE

[75] Inventor: Toru Shibata, Nirasaki, Japan

[73] Assignee: Mitsui Kinzoku Kogyo Kabushiki Kaisha, Tokyo, Japan

[21] Appl. No.: 796,295

[22] Filed: Nov. 22, 1991

[30] Foreign Application Priority Data

Nov. 27, 1990 [JP] Japan ..... 2-324011

[51] Int. Cl.[5] ..... E05C 3/26

[52] U.S. Cl. ..... 292/216; 292/DIG. 56

[58] Field of Search ..... 292/216, DIG. 40:DIG. 56, 292/280, 201, 341.12

[56] References Cited

U.S. PATENT DOCUMENTS 4,130,308 12/1978 Jeavons ..... 292/216
4,756,563 7/1988 Garwood et al. ..... 292/216
5,064,229 11/1991 Hamada et al. ..... 292/216

*Primary Examiner*—Richard E. Moore
*Attorney, Agent, or Firm*—Browdy and Neimark

[57] ABSTRACT

A vehicle door lock device consists of a striker and a lock body. The striker has a pair of straight leg portions and arc shape portions, respectively formed at end portions of the leg portions. The lock body has a guide groove through which the striker proceeds or moves, a latch adapted to engage with the striker entering the guide groove, a ratchet keeping an engaged condition of the latch and striker, and a resilient stopper positioned at an end of the guide groove. The stopper has a first abutting portion against which the straight leg portion abuts and an arc shape second abutting portion against which the arc shape portions of the striker abuts. The leg portion abuts against the first abutting portion when the latch of the lock device situates at its mid position between the half latched position or condition and the full latched position or condition of the latch. While, the arc shape portion of the striker and the second abutting portion of the stopper abuts against each other, when the lock device or latch situates at its full latched position. The first abutting portion and/or the second abutting portion have groove portions of arc shape in section, improving a contact efficiency of the stopper and the striker.

4 Claims, 4 Drawing Sheets

VEHICLE DOOR LOCK DEVICE

FIELD OF THE INVENTION

The present invention relates to a vehicle door lock device, in particular, an improved elastic stopper adapted to abut against a striker.

BACKGROUND OF THE INVENTION

According to the conventional and known door lock device shown in FIG. 6, it has a latch B engageable with a striker A secured to a vehicle chassis or frame and a ratchet C for holding an engagement between the latch B and the striker A. When a door of the vehicle shuts, the striker A disadvantageously proceeds in a very high speed through a groove E formed in a lock body D, engages with a fork portion F of the latch B, and finally strikes a stopper G made of an elastic rubber placed at a most depth position of the groove E and stops there. A feeling of hands of a closing door is determined definitely by function of the stopper G, so various shapes of the stopper G have been developed according to particular constructions and functions of the conventional lock devices in order to make the hand feeling of the closing door good.

The striker A shown in FIG. 7 is of a very popular or common type, and consists of a metal made base plate H and a U shape rod L made by two leg portions I and J and a bridge portion K. It is noted that the fork portion F of the latch B engages with the straight leg portion I and a front end of the leg portion I joins the bridge portion K through an arc shape portion M.

As shown in FIG. 8, the stopper G has a size enabling completely to abut against the straight leg portion I and the arc shape portion M. It is noted that the stopper G has an upper part O and a lower part N, the former engaging with the arc shape portion M and the latter engaging with the straight leg portion I. It is only the lower part N of the stopper G that various ideas are applied to, and no effective development has been applied to the upper part O abutting against the arc shape portion M.

SUMMARY OF THE INVENTION

Consequently, it is the purpose of the present invention to provide a stopper improved to increase its functional effect by developing and devising the shape of the part O of the stopper G abutting against the arc shape portion M of the U shape rod L.

PREFERRED EMBODIMENT OF THE INVENTION

Figure 3:
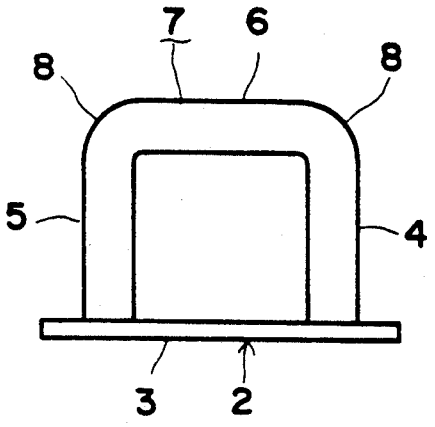
FIG. 3 is a plan view of the striker.
Figure 7:
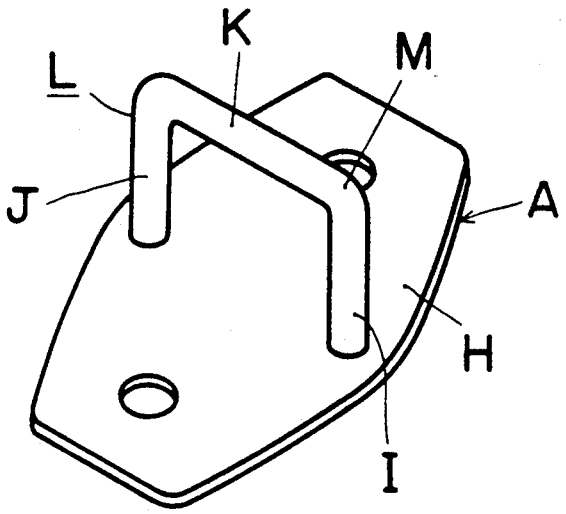
FIG. 7 is a perspective view of the conventional striker.
Figure 8:
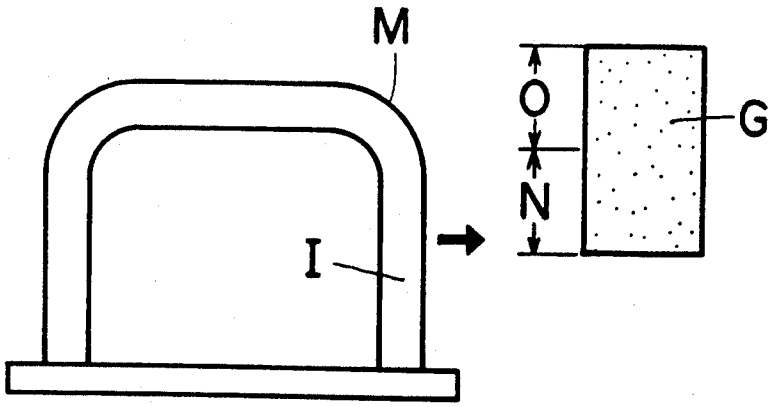
FIG. 8 depicts a functional relationship between the conventional striker and the conventional stopper.

An embodiment of the vehicle door lock device according to the present invention will be explained with reference to the accompanying drawing. The striker shown in FIG. 3 is identical to that of FIG. 7 and consists of a base plate 3 secured to the vehicle frame or chassis and a U shape rod 7 having two leg portions 4 and 5, each extending forward horizontally from the base plate 3 and a bridge portion 6 connecting both ends of these leg portions 4 and 5. The rod 7 is made by bending a round bar in U shape, forming a pair of arc shape portion 8 at each bent.

Figure 1:
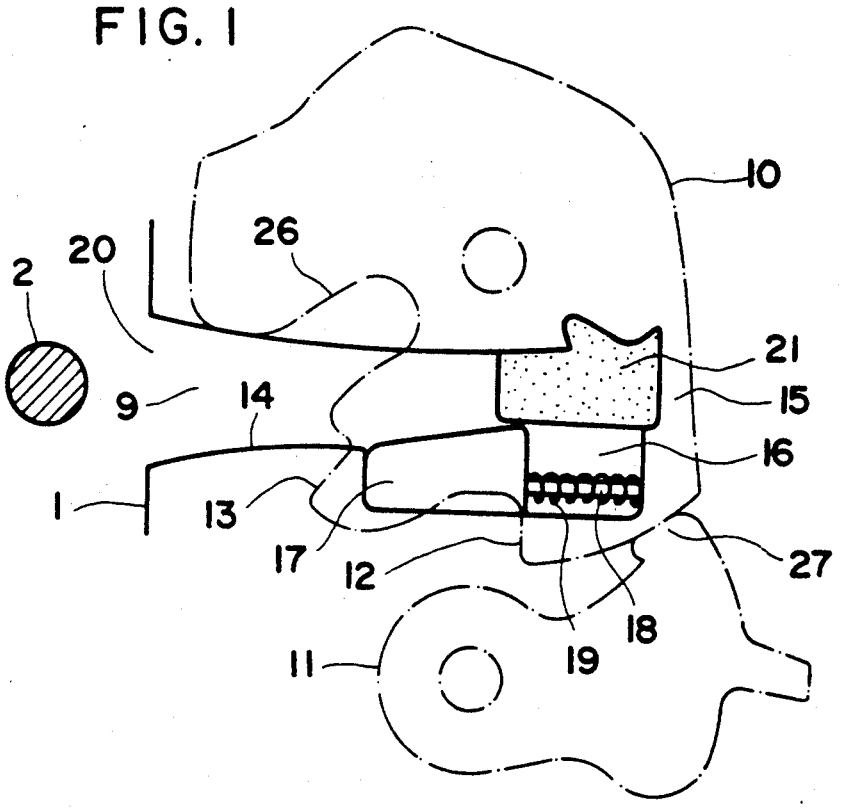
FIG. 1 is a front view of the vehicle door lock device according to one embodiment of the present invention.
Figure 2:
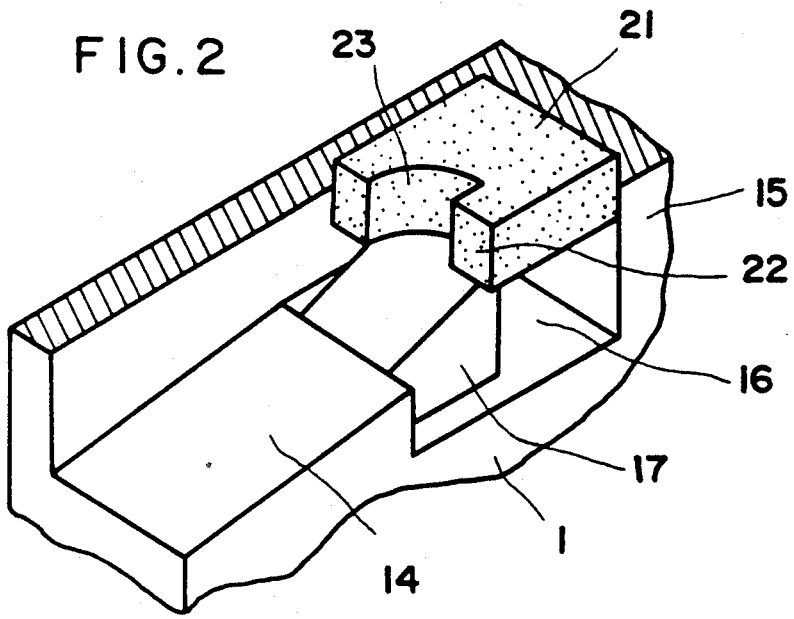
FIG. 2 is an enlarged perspective view of the stopper and the groove.

A plastic or synthetic resin made body 1 of the door lock device secured to the door has a guide groove 9 formed thereon so as to make the striker 2 proceeds or be inserted into the guide groove 9. The latch 10 provided with a fork portion 26 adapted to engage with the striker 2 and the ratchet 11 for keeping an engagement between the latch 10 and the striker 2 are rotatably journalled with the body 1. When the latch 10 engages with the striker 2, the latch 10 rotates counterclockwise in FIG. 1. When the latch 10 rotates to its half latched position or condition, a claw 27 of the ratchet 11 engages with a half latched stepped portion 12 of the latch 10. When the latch 10 rotates to its full latched position, the claw 27 engages with the full latched stepped portion 13.

On the bottom wall 14 at a deep side 15 (the right side on FIG. 1) of the guide groove 9, there is a concave portion 16 accommodating a slide piece 17. The slide piece 17 is adapted to slidably fit on a guide bar 18 arranged in parallel to a proceeding direction of the striker 2. Ordinarily, the slide piece 17 is urged to a side of the entrance 20 through a spring 19. When the striker 2 proceeds through the guide groove 9, the slide piece 17 contacts with the striker 2 and moves toward the deep place.

A stopper 21 made of elastic material such as rubber and the like is attached to an end of the guide groove 9 at the deep side 15, to which end of the guide groove 9 the striker 2 strikes. The elastic stopper 21 has a first abutting portion 22 against which the leg portion 4 abuts and a second abutting portion 23 against which the arc shape portion 8 abuts. The first abutting portion 22 is of a flat surface type and the second abutting portion 23 has an arc shape identical with that of the arc shape portion 8. It is necessary to make an abutting or contact between the leg portion 4 and the first abutting portion 22 and another or contact between the arc shape portion 8 and the second abutting portion 23 impossible to happen at the same time. That is, first abutting is happened between the leg portion 4 and the first abutting portion 22, and then another abutting happens between the arc shape portion 8 and the second abutting portion 23.

Figure 5:
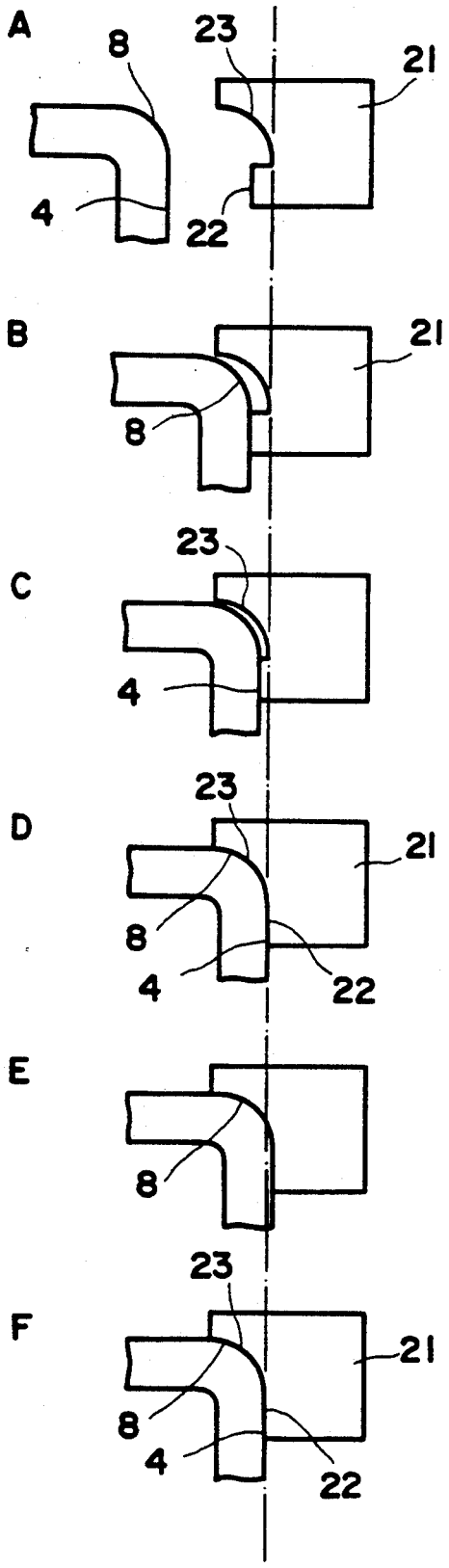
FIG. 5A to FIG. 5F are operative relationship views of the striker and the stopper.
Figure 6:
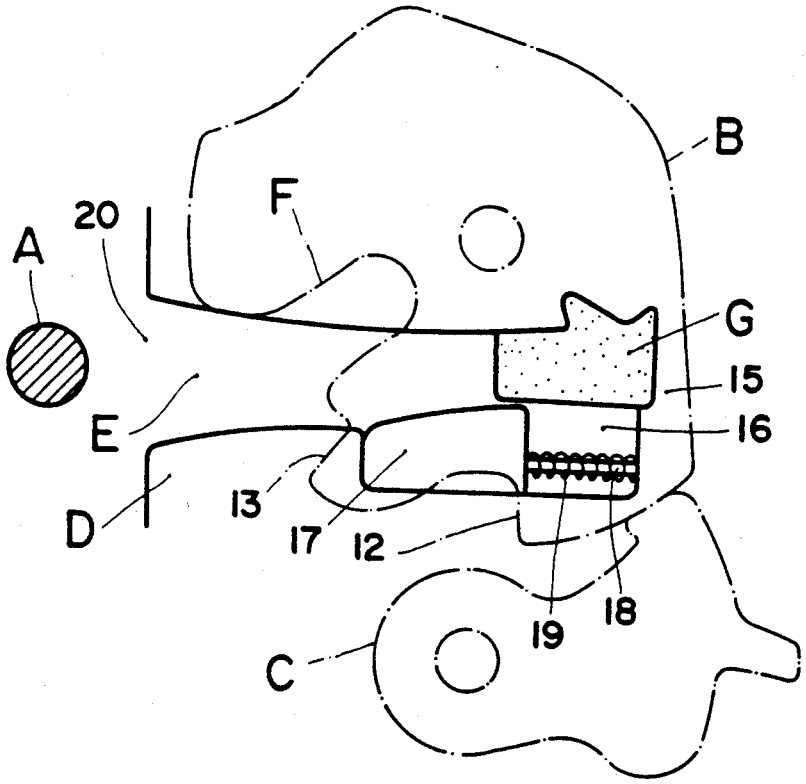
FIG. 6 is a plan view of the vehicle lock device according to the prior art.

FIG. 5 is a sequence of top plane views showing the sequential striking of the striker 2 against the stopper 21. Closing the door, first the leg portion 4 abuts against the abutting portion 22. When the leg portion 4 abuts against the abutting portion 22, the striker 2 proceeds to substantially a mid portion between its half latched position and its full latched position. The arc shape portion 8 abuts against the second abutting portion 23 when the striker 2 proceeds to substantially a full latched position of the latch 10. Consequently, the striker 2 can proceed to the mid position substantially without resistance. After passing the mid position, a moment of the striker 2 is absorbed through weak resiliency of the first abutting portion 22. When the striker 2 reaches substantially the full latched position, the moment of inertia of the striker 2 is absorbed through strong resiliency of the second abutting portion 23 in addition to the first abutting portion 22. As described above, the moment of inertia is absorbed step-by-step improving a feeling of closing door to hands.

Figure 4:
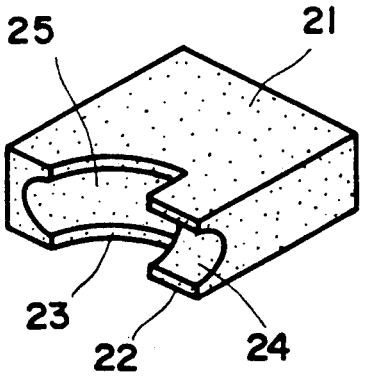
FIG. 4 is a perspective view of the stopper according to another embodiment of the present invention.

FIG. 4 depicts another embodiment of the rubber stopper 21 of the door lock device according to the present invention. As shown the rubber stopper 21 has arc shape grooves 24 and 25 corresponding to a sectional shape of the rod 7, formed in the first and second abutting portions 22 and 23 thereof.

Next, operation of the door lock device employing the stopper 21 of the second embodiment will be explained.

According to the vehicle door lock device provided with such construction mentioned above, when the door is closing, the U shape rod 7 of the striker 2 proceeds through the interior of the guide groove 9, the leg portion 4 of the U shape rod 7 pushes the latch 10 and makes it rotate, and the leg portion 4 reaches its half latched position. At that time, the claw 27 of the ratchet 11 engages with the half latched stepped portion 12 of the latch 10. When the striker 2 further proceeds and reaches substantially a mid position between the half latched position and the full latched one, the leg portion 4 of the U shape rod 7 as shown in FIG. 5B abuts against the first abutting portion 22 of the stopper 21, so only resilient force of the first abutting portion 22 absorbs a moment of inertia of the striker 2.

When the striker 2 further proceeds against resilient force of the first abutting force 22 and reaches substantially the full latched position of the latch 10, the arc shape portion 8 of the rod 7 abuts against the second abutting portion 23. Consequently, a strong resilient force of the first abutting portion 22 together with of the second abutting portion 23 absorb instantly moment of inertia of the striker 2, obtaining a good feeling of hands of closing door.

In addition, as shown in FIG. 4, forming these arc shape groove portions 24 and 25 corresponding to the sectional shape of the U shape rod 7 on the first abutting portion 22 or the second abutting portion 23 additionally increases the contact surface area to the leg portion 4 of the rod 7, resulting in a considerable effect of the rubber stopper 21.

What is claimed is:

1. A vehicle door lock device comprising a striker secured to a vehicle chassis, said striker having a first straight leg portion and a second straight leg portion and an arc shape portion formed at the front end of each of said first straight leg portion and said second straight leg portion a lock body secured to a vehicle door, wherein said lock body has a guide groove through which said striker proceeds, a latch adapted to engage with the striker proceeding through the guide groove, a ratchet for keeping an engagement of the latch with the striker, and a resilient stopper formed at an end of the guide groove, wherein said stopper has a first abutting portion against which said first straight leg portion strikes and an arc-shaped second abutting portion against which said arc shape portion of said first straight leg portion strikes.

2. The vehicle door lock device according to claim 1, wherein said arc shape portion of said first straight leg portion and said second abutting portion are adapted to abut against each other after said first straight leg portion abuts against said first abutting portion.

3. The vehicle door lock device according to claim 1, wherein said first abutting portion and/or the second abutting portion has grooves of arc shape in section.

4. The vehicle door lock device according to claim 2, wherein the second abutting portion and said arc shape portion are adapted to abut against each other at a full latched condition of the lock device.

* * * * *